United States Patent [19]

Wayne

[11] 4,444,381

[45] Apr. 24, 1984

[54] OPERATING TABLE ACCESSORY, PARTICULARLY FOR LUMBAR LAMINECTOMIES

[76] Inventor: Sherwyn J. Wayne, 896 Blue Spring La., Frontenac, Mo. 63131

[21] Appl. No.: 376,944

[22] Filed: May 11, 1982

[51] Int. Cl.[3] ..... A61G 13/00

[52] U.S. Cl. ..... 269/328

[58] Field of Search ..... 5/431, 443, 433; 269/322–328

[56] References Cited

U.S. PATENT DOCUMENTS

| | | | |
|---|---|---|---|
| 1,218,876 | 3/1917 | Liverson | 5/431 |
| 1,780,479 | 11/1930 | Griffith | 5/443 |
| 2,577,177 | 12/1951 | Anderson | 269/322 |
| 2,678,857 | 5/1954 | Hans | 269/328 |
| 2,819,133 | 1/1958 | Party | 269/328 |
| 3,493,225 | 2/1970 | Ceraldi | 269/322 |
| 3,643,938 | 2/1972 | Levasseur | 269/328 |
| 3,810,462 | 5/1974 | Szpur | 269/328 |
| 3,949,983 | 4/1976 | Tommasino | 269/328 |

FOREIGN PATENT DOCUMENTS

| | | | |
|---|---|---|---|
| 74680 | 4/1952 | Denmark | 5/443 |
| 1262696 | 4/1961 | France | 269/328 |
| 1377482 | 9/1963 | France | 5/433 |
| 280039 | 5/1930 | Italy | 269/323 |

OTHER PUBLICATIONS

Journal of Bone and Joint Surgery; Jan. 1981, "The Hicks Spinal Surgery Frame", (Advertisement).

*Primary Examiner*—Robert C. Watson

*Attorney, Agent, or Firm*—Senniger, Powers, Leavitt and Roedel

[57] ABSTRACT

An operating table accessory, particularly for lumbar laminectomies, comprising a roller supported on rods adapted to be mounted in crutch sockets at opposite sides of the operating table, whereby after an anesthetized patient has been placed on the table in a tuck position, the accessory may be manipulated for engagement of the roller under the patient's buttocks and for positioning of the roller to maintain the buttocks raised.

3 Claims, 5 Drawing Figures

OPERATING TABLE ACCESSORY, PARTICULARLY FOR LUMBAR LAMINECTOMIES

BACKGROUND OF THE INVENTION

This invention relates to an operating table accessory, and more particularly to an accessory for positioning a patient on an operating table for the performance of a lumbar laminectomy, i.e., an operation usually performed to remove a damaged intervertebral disc.

Lumbar laminectomies have been performed in many instances with the patient on the operating table in what has been referred to as the "tuck position", in which the patient is on his knees on the table, the knees being spread apart, the patient's chest and abdomen hanging free. Reference may be made to my article entitled "The Tuck Position for Lumbar-Disc Surgery" at pages 1195–1198 of the September 1967 issue, Vol. 49-A, No. 6, The Journal of Bone and Joint Surgery, a copy of a reprint of this article being appended. A lumbar laminectomy is a complex and delicate operation, with the possibility of complications such as excessive hemorrhage from epidural veins, life-threatening injuries to retroperitoneal major blood vessels and tearing of spinal nerves or the dura. While use of the tuck position appears to have generally satisfactorily reduced the possibility of such complications, I have observed that under certain circumstances, with surgeons of varied experience, the patient might be exposed to risks, particularly two complications:

(1) phlebothrombosis or arterial thrombosis resulting from vascular compression at the hip or knee; and (2) myoglobulinuria with secondary renal impairment stemming from gastroc-soleus muscle necrosis due to compression by the body's weight. I know of reports in the literature of two such occurrences.

SUMMARY OF THE INVENTION

Among the several objects of the invention may be noted the provision of an operating table accessory particularly for use in performing lumbar laminectomies with the patient in a modified tuck position for preventing the possibility of rare pressure-related lower extremity muscular and vascular complications, the provision of such an accessory which, while reducing the degree of spinal flexion of the patient, maintains ample exposure to the patient for the operation, and which enables performance of most uncomplicated procedures with minimum bone removal and preservation of the interspinous ligament; the provision of such an accessory which enables performance of the operation without such tension in the lumbar fascia as may make closure difficult; the provision of such an accessory which allows an optimal degree of hip and knee flexion relaxing the spinal nerves; and the provision of such an accessory which is relatively easy to use.

In general, an accessory of this invention, which is particularly for, though not limited to, use in positioning a patient in a modified tuck position on an operating table for a lumbar laminectomy, comprises a roller and a pair of rods for supporting the roller, one at each end of the roller. Each rod extends generally at right angles to the axis of the roller. The accessory is used on an operating table which has means at each side for receiving the ends of the rods and holding the accessory for being moved lengthwise of the table and swung around a generally horizontal axis extending transversely with respect to the table, whereby after a patient is placed on the table in a tuck position, the rods may be mounted in said means and the accessory manipulated for engagement of the roller under the patient's buttocks and positioning of the roller to maintain the buttocks lifted.

Other objects and features will be in part apparent and in part pointed out hereinafter.

BRIEF DESCRIPTION OF THE DRAWINGS

Corresponding reference characters indicate corresponding parts througout the several views of the drawings.

DESCRIPTION OF THE PREFERRED EMBODIMENT

Figure 1:
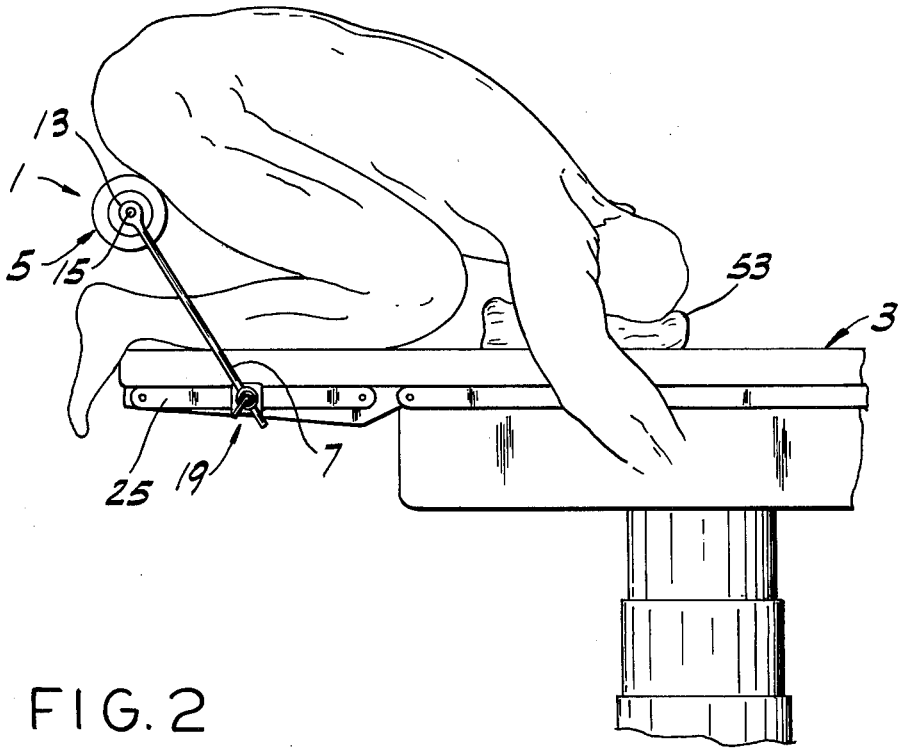
FIG. 1 is a view in side elevation of an operating table with an accessory of this invention thereon showing how it maintains the patient's buttocks raised, parts of the table being broken away.
Figure 2:
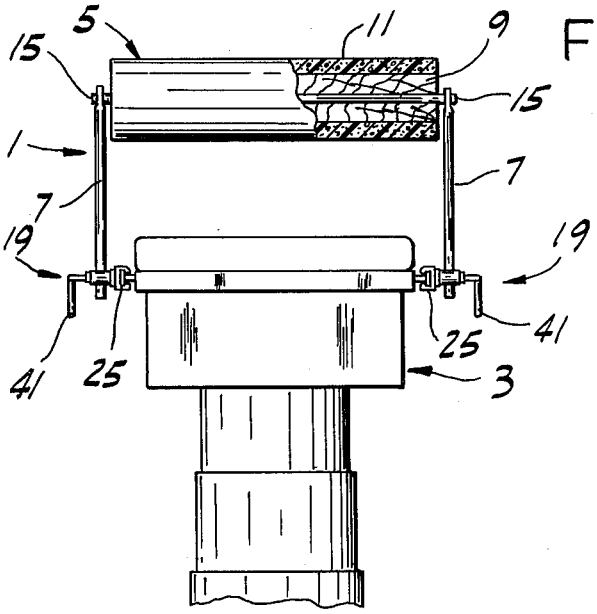
FIG. 2 is an end view as viewed from the left of FIG. 1 without the patient showing a roller of the accessory broken away and in section.
Figure 3:
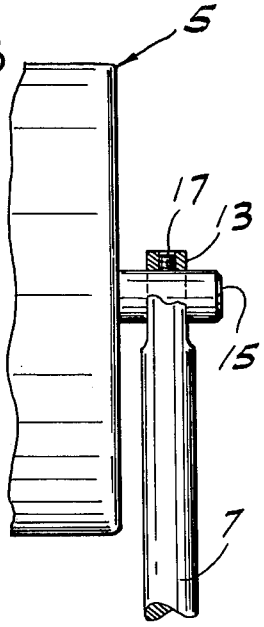
FIG. 3 is a view showing how a shaft for the roller is mounted in an eye on a rod of the accessory.
Figure 4:
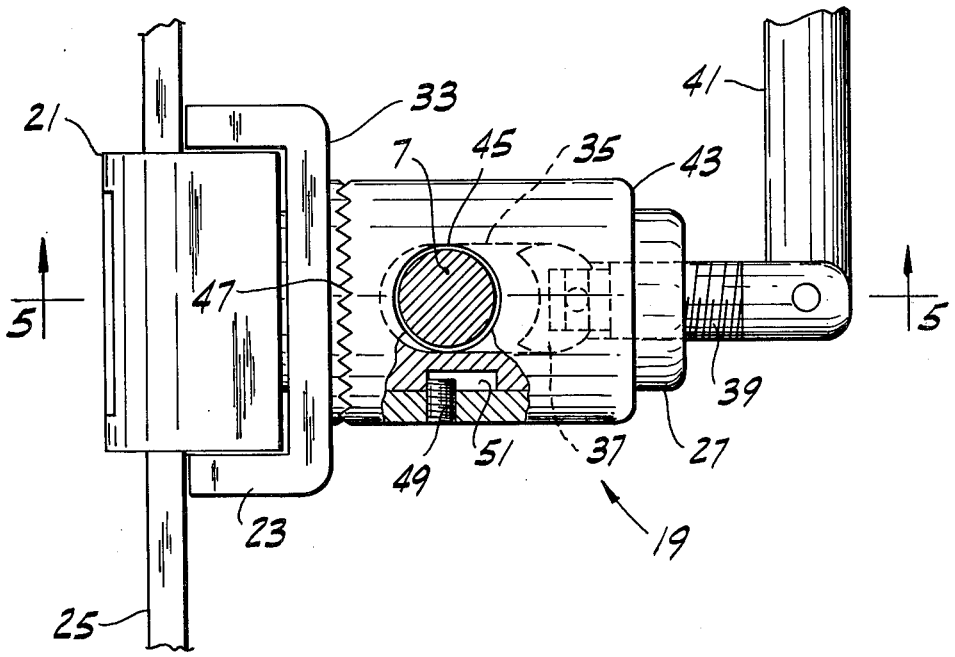
FIGS. 4 and 5 are views showing a crutch socket such as used at each side of the table for mounting the accessory, FIG. 4 being a plan with parts broken away and shown in section, and FIG. 5 being a section on line 5—5 of FIG. 4.
Figure 5:
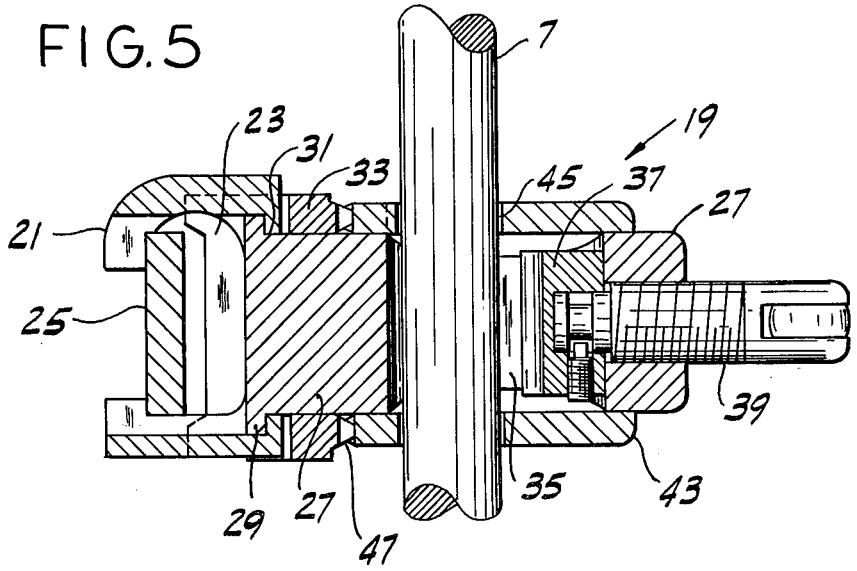

Referring to the drawings, there is generally indicated at 1 an operating table accessory of this invention particularly for use in positioning a patient in a modified tuck position on an operating table 3 for a lumbar laminectomy. Basically, the accessory comprises a roller 5, which may be about 23⅞" long and abou 6⅛" in diameter, for example, and a pair of rods each designated 7 for supporting the roller, one at each end of the roller, each rod extending generally at right angles to the axis of the roller. More particularly, the roller 5 comprises a core 9, which may be made of wood, and a cushioning pad 11 on the core comprising, for example, a cylindrical sleeve of a polyurethane cushioning material, the core being about 3⅝" in diameter and the pad being about 1¼" thick, for example. The rods 7, which may be of about ⅝" diameter and 16⅝" long, for example, have eyes 13 at their ends receiving the ends of a shaft 15 extending axially through the core of the roller, the ends of the shaft being secured in the eyes by means by set screws 17.

The operating table is of a type conventionally used for lumbar laminectomies. It is equipped with means indicated generally at 19 at each side for receiving the free (lower) ends of the rods 7 and holding the accessory 1 for being moved lengthwise of the table and swung around a generally horizontal axis extending transversely with respect to the table, whereby, after a patient is placed on the table in a tuck position, the rods 7 may be mounted in the means 19 and the accessory manipulated for engagement of the roller 5 under the patient's buttocks and positioning of the roller to maintain the buttocks lifted.

Each rod mounting means 19 is constituted by what is generally referred to in the operating table art as a crutch socket, which may be of a type comprising a pair of jaws 21 and 23 adapted to clamp on a side rail 25 of the table. A stem 27 has a head 29 in jaw 21 and extends through a hole 31 in the jaw 21 and a base 33 of jaw 23.

The stem has a longitudinal slot 35 and a rod clamp 37 slidable in the slot operable by a screw 39 threaded in the stem at its outer end. The screw has a pivoted handle 41. A sleeve 43 slidable on the stem 27 has holes 45 for a rod 7, the rod passing through one of these holes, through the slot 35 and through the other hole 45, and the sleeve and the base 33 of jaw have interengageable teeth 47. The sleeve has a set screw 49 slidable in a longitudinal groove 51 in the stem 27. With regard to this type of clutch socket, which is commercially available from Affiliated Hospital Products, Inc. of St. Louis, Mo. on that company's operating tables, backing off the screw 39 loosens the clamp jaws 21, 23 enabling sliding the clutch socket along the table side rail 25. It also enables rotation of the stem 27 and sleeve 43, and hence a rod 7 extending through the stem and sleeve, on the horizontal axis of the stem and sleeve, and adjustment of the rod transversely of the axis of the stem and the sleeve.

Preparatory to performing a lumbar laminectomy using the accessory 1, the patient, having been anesthetized on a hospital cart, has his knees flexed toward the chest, for assuming the tuck position, and is rolled over with his knees thus flexed and in the knee-chest position from the cart on to the operating table and brought into the full tuck position, appropriate bolsters being placed under his shoulders and head as indicated at 53 in FIG. 1. This is carried out with the accessory 1 removed from the table. In the full tuck position, the patient's buttocks are down generally on the patient's heels, and the tacks of his thighs are down on the calves of his legs. After the patient is in the stated full tuck position on the operating table with the bolsters 53 under his shoulders and head, the rods 7 of the accessory 1 are entered into the holes 45 and slots 35 therefor of the crutch sockets 19, the latter being in such position relative to the patient on the table in the full tuck position as to enable the mounting of the rods 7 in the crutch sockets. The roller 5 is covered with a disposable wrapper of paper or other suitable material. The patient's buttocks are raised and the accessory 1 manipulated for engagement of the roller 5 under the buttocks and positioning of the roller as shown in FIG. 1 to maintain the buttocks raised, this manipulation involving moving the accessory 1 forward (by sliding the crutch sockets 19 forward in the rails 25) and/or swinging the accessory clockwise as viewed in FIG. 1 as permitted by rotation of stems 27 and sleeves 43 of the crutch sockets, and then tightening the screw 39 of each crutch socket to lock the accessory in place. The procedure is nicely facilitated by reason of the rolling of the roller 5 against the buttocks (the roller being rotatable on the shaft 15). Generally, the buttocks are raised to and held in a position for maintaining approximately 110° of flexion of the hips and knees.

Following the above, the operating table is generally placed in a reverse Trendelenburg position, wherein the patient's back is slightly inclined forward and the major portion of the patient's weight rests on the roller 5. The knee rest of the table (not shown) may be lowered to allow the surgeon to work from either side or caudally as the situation dictates. The upper portion of the table may be slightly flexed to avoid cervical hyperextension.

I have carried out a sufficient number of lumbar laminectomies using the accessory 1 to establish that it not only appears to accomplish the objectives above stated, but also reduces the average post-operative stay of the patient.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An operating table having rod-end receiving means at each side, each said rod-end receiving means being movable lengthwise of the table and rotatable around a generally horizontal axis extending transversely with respect to the table, each rod-receiving means having an opening extending transversely to its axis of rotation for receiving a rod and means for clamping the rod in the opening, and an accessory on the table for use in positioning a patient in a modified tuck position on the table for a lumbar laminectomy, said accessory comprising a roller in a position extending transversely of the table above the table, and a pair, one at each end of the roller, of rigid rods for rotatably supporting the roller in said position, each rod extending downwardly generally at right angles to the axis of the roller, and having its lower end detachably clamped in position in the opening in a respective rod-receiving means at a respective side of the table, said accessory being manipulable by adjustment of the rods in the openings,, movement of the rod-receiving means lengthwise of the table and rotation of the rod-receiving means, rods and roller about said axis for engagement of the roller under the patent's buttocks and positioning of the roller to maintain the buttocks lifted.

2. The table and accessory of claim 1 wherein the roller of the accessory comprises a core rotatable on a shaft and a pad on the core.

3. The table and accessory of claim 2 wherein the shaft extends out of the core at both ends, each rod has an eye at one end receiving a respective end of the shaft, and means is provided for securing the ends of the shaft in the eyes.

* * * * *